US005944639A

United States Patent [19]

Ray

[11] Patent Number: 5,944,639

[45] **Date of Patent: *Aug. 31, 1999**

[54] QUICK CHANGE ADJUSTABLE HEIGHT SPEED BAG

[76] Inventor: Randy Ray, Rte. 2, Box 127, Noel, Mo. 64854

[ * ] Notice: This patent is subject to a terminal disclaimer.

[21] Appl. No.: 09/028,487

[22] Filed: Feb. 24, 1998

Related U.S. Application Data

[63] Continuation-in-part of application No. 08/759,118, Dec. 2, 1996, Pat. No. 5,800,320.

[51] Int. Cl.[6] ..... A63B 69/00

[52] U.S. Cl. ..... 482/87; 482/83; 482/908

[58] Field of Search ..... 482/83, 84, 85, 482/86, 87, 88, 89, 908; 473/442, 443

[56] References Cited

U.S. PATENT DOCUMENTS

| | | | |
|---|---|---|---|
| 740,160 | 9/1903 | Mills | 482/87 X |
| 992,868 | 5/1911 | Gorman | 482/87 |
| 1,708,638 | 4/1929 | Smith | 482/87 X |
| 2,012,899 | 8/1935 | Thorson . | |
| 2,625,356 | 1/1953 | Kennedy | 482/90 X |
| 2,659,603 | 11/1953 | Glasser | 482/87 |
| 2,697,603 | 12/1954 | Haines | 482/87 |
| 3,281,148 | 10/1966 | Cummins | 473/442 |
| 3,510,131 | 5/1970 | Gardner | 482/90 |
| 4,441,706 | 4/1984 | Korzaniewski . | |
| 4,491,316 | 1/1985 | Prince . | |
| 4,653,746 | 3/1987 | Brunier | 482/87 |
| 4,749,184 | 6/1988 | Tobin | 482/87 |
| 5,050,866 | 9/1991 | Fucci | 482/90 |
| 5,147,258 | 9/1992 | Donohue | 482/87 |
| 5,224,912 | 7/1993 | Moody | 482/87 |
| 5,484,364 | 1/1996 | Boring | 482/87 |
| 5,800,320 | 9/1998 | Ray | 482/87 |

FOREIGN PATENT DOCUMENTS

| | | | |
|---|---|---|---|
| 0461281 | 6/1928 | Germany | 482/86 |

*Primary Examiner*—Richard J. Apley
*Assistant Examiner*—William LaMarca
*Attorney, Agent, or Firm*—Jacobson, Price, Holman & Stern, PLLC

[57] ABSTRACT

An apparatus for practice and demonstrating defense arts, such as karate, includes a vertical wall-mounted main frame unit assembled of a pair of vertical, symmetrical, cylinder shaped tubes secured to three horizontally extending wall mounting brackets or to a free standing frame unit. The purpose of the invention is to support a height adjustable hanging target, such as a speed bag or heavy bag, which the artisan strikes with various human appendages, such as the hand or foot and other certain appropriate weapons. The hanging target is supported by a striking bag carriage assembly and a striking bag platform as it rides along the vertical tubing.

19 Claims, 18 Drawing Sheets

QUICK CHANGE ADJUSTABLE HEIGHT SPEED BAG

This application is a continuation-in-part of application Ser. No. 08/759,118, filed Dec. 2, 1996, now U.S. Pat. No. 5,800,320.

FIELD OF THE INVENTION

The present invention pertains to an apparatus which supports a target, such as a striking bag and/or heavy bag, for practicing and demonstrating defense arts, such as karate, by striking blows delivered by the hand or foot and other appropriate weapons. The quick adjustment of height facilitates effective practice or demonstration by the shortest to the tallest of artisans as well as facilitating attachment and removal of the heavy bag.

BACKGROUND OF THE INVENTION

There is a need for a striking apparatus which combines features of adequate safety, ease of adjustment of height, maximization of space utilization, ease of installation, cosmetic acceptability, reasonable design simplicity and quick and easy progress monitoring in the art of self defense where swift and effective blows are to be delivered accurately and blocked successfully.

SUMMARY OF THE INVENTION

The needed features have been incorporated into the present invention and facilitate excellent skill development for all ages and sizes of artisans.

Accordingly, an object of present invention is to provide an apparatus for practice toward development of excellent skills in the defensive arts such as karate.

An apparatus according to the present invention for practice and demonstrating defense arts, such as karate, includes a vertical wall-mounted main frame unit assembled of a pair of vertical, symmetrical, cylinder shaped tubes secured to three horizontally extending wall mounting brackets. The purpose of the invention is to support a height adjustable hanging target, such as a speed bag and/or heavy bag, which the artisan strikes with various human appendages, such as the hand or foot and other certain appropriate weapons. The hanging target is supported by a striking bag carriage assembly and a striking bag platform as it rides along the vertical tubing.

The three wall mounting brackets are constructed of rectangular steel tubing and facilitate versatile wall mounting at either sixteen or twenty-four inch stud center spacing. These brackets are firmly mounted to the wall with lag screws or other appropriate types of mounting fasteners.

The bottom of the frame sits at floor level and preferably extends to a height of eight feet and optionally to a height of ten feet. The wall bracket tubing is end capped with protective plastic inserts. The cylindrical tubing is capped off at floor level only with protective caps allowing a cable extending from the top of the cylindrical tubes to move restriction free in and out of the cylindrical tubes.

Alternatively, a free standing frame may be used. The free standing frame, to which the target striking assembly is attached, is movable on wheels and foldable to a space saving configuration.

The striking bag carriage assembly and striking bag platform of the target striking assembly ride up and down along the cylindrical tubes on four free rolling nylon roller bearing assemblies and are counterbalanced with two 40 pound weights. The weights are enclosed within the main frame cylindrical members and are supported by rollers and cables. The weights include a cap or plastic coating at their end to reduce noise and vibration as the weights travel through the cylindrical members.

Attached to the carriage assembly are two friction locks, controlled by two hand operated knobs. The knobs serve as hand grips to raise and lower the carriage assembly to the desired elevation. The friction locks may take the form of a brake pad made of UHMW and be shaped to have a surface contacting the cylindrical member, shaped complementary to the cylindrical member.

The striking target will normally be a vinyl strike bag with lacing, welted seams, a removable air bladder and a reinforced attachment loop. The striking bag platform has a chrome plated, target locking, ball-bearing swivel mounted at its center to which a striking target is attached. The perimeter of the striking bag platform is lined with soft, impact resistant, rubber edging for added striking safety. The upper and lower surfaces of the striking bag platform are faced with high impact resistant sheeting for wear resistance and cosmetic appearance.

Attached to one side of the vertical main frame unit is an inch/foot measuring scale for ready gauging of desired height of the striking bag platform assembly and for monitoring individual progress.

The present invention provides a support for a target, such as a striking bag, on which the blow is to be struck, which is adjustable through a wide range of vertical positions. This allows the artisan to practice striking and blocking skills over the entire range of normal points of aim and attack.

By the present invention, individuals of all heights and ages can practice numerous striking and blocking skills in the art of self defense on the same equipment and yet be equally challenged. As one continues to improve, they can monitor their individual progress with the scale attached to the vertical main frame unit.

In one aspect of the present invention, the artisan can improve their aim, force and technique in numerous hand strikes such as side-fist punches, ram's head and hammer head punches, and also various backhand strikes, palm heel hits, and finger strikes.

In another aspect of the present invention the artisan can improve their aim, force and technique in a number of different foot strikes and kicks, such as crescent kicks, rear kicks, chicken kicks, wheel kicks, and various spinning, jumping and flying kicks. This improves aim, strength, force and balance.

A third aspect of the present invention is the versatility the artisan has due to the wide range of height adjustment this apparatus affords. One can practice from below the knee kicks such as "shin kicks" to above the shoulder kicks. The artisan can also practice hand, wrist and elbow strikes at various levels of position.

A further aspect of this invention is that the artisan can use the striking target to practice striking from various positions with certain appropriate striking weapons such as a staff and a yawara stick.

The present invention also allows for one to practice upper body blocking skills from the returning blow of the target.

The present invention maximizes space utilization and provides ease of installation. It is wall mounted to increase stability and greatly reduces required space for utilization while optionally being attached to a movable, free standing frame. Wall mounting holes are spaced to accommodate wall studs on sixteen or twenty-four inch centers. The mounting of an apparatus can also be adapted to other types of wall construction. The user of this invention will also appreciate the safety features incorporated into this apparatus.

The striking bag platform is readily and easily adjustable with two hand operated stabilizing locks. The entire striking bag carriage assembly is counterbalanced for ease and safety during elevation changes. The perimeter of the striking bag platform is protected by a soft rubber edging that in turn helps to protect the artisan from misplaced blows. The weighted counter-balances and cable pulleys are enclosed to protect the operator from possible injury.

In the event of a counterweight becoming detached from its cable and falling, the counterweight is entirely enclosed within a cylindrical tube to prevent bodily contact. Also, two balancing assemblies are utilized, reducing the probability of injury resulting from total machine failure.

The strike target is swivel mounted not only to provide for a free range of movements from various angles of position, but also to eliminate resistance to strike angles. A rebounding backboard allows the artisan to practice reaction time and training to successfully respond to returning blows of the target with strikes and/or blocks.

The same striking bag platform may include an assembly for mounting a removable heavy bag on the striking bag platform. A spring biased eye bolt is movable through a hole in the striking bag platform for securing the eye bolt to a heavy bag. Upon removal of the heavy bag the bias of its spring retracts the eye bolt to a position recessed in the hole of the striking bag platform and out of the way from interfering with the movement of the striking bag.

Accordingly, it is an object of the present invention to provide a quick change adjustable height speed bag which is movable by two counterweights having protective coated ends, enclosed within two vertically extending tubes.

It is another object of the present invention to provide an adjustable height speed bag and/or heavy bag by moving a striking bag carriage assembly to a predetermined position and fixing the location of the carriage assembly by two bearing and lock assemblies.

It is still another object of the present invention to provide an adjustable height speed bag and/or heavy bag having a striking bag platform assembly mounted on a striking bag carriage assembly with the carriage assembly being manually vertically movable against the force of two counterweights housed within two vertically extending tubes and with the position of the carriage assembly being fixable at a predetermined location.

It still yet another object of the present invention to provide an opening in a striking bag platform through which a pivotal connection for a heavy bag can be optionally moved for securing a heavy bag to a striking bag platform and retracting the pivotal connection upon release of the heavy bag.

It is still yet another object of the present invention to secure a target striking assembly to a free standing frame which is movable by rollers to different locations and which is foldable upon itself for storage.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
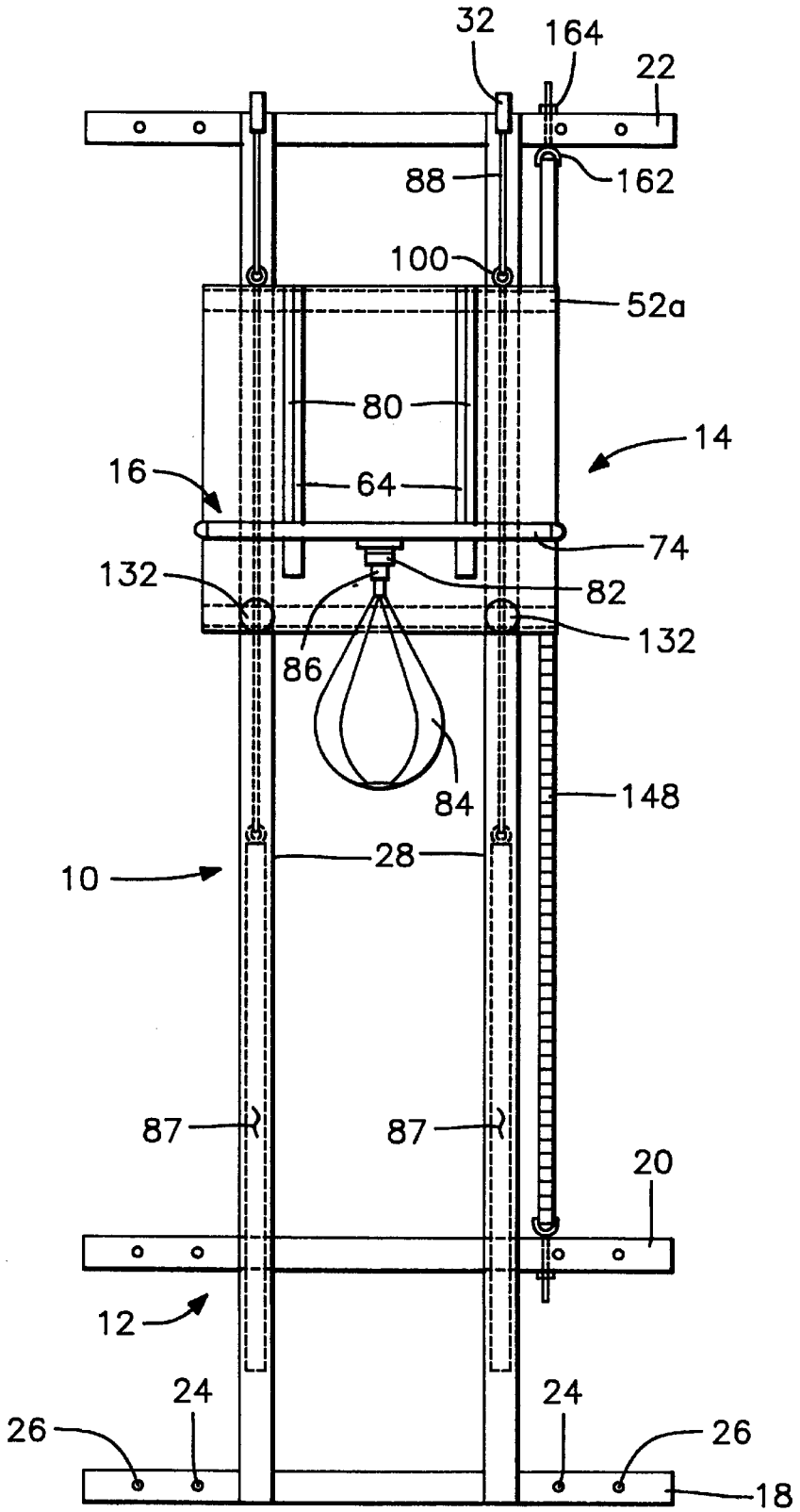
FIG. 1 is a front elevational view of an apparatus for practicing defense arts in accordance with the present invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
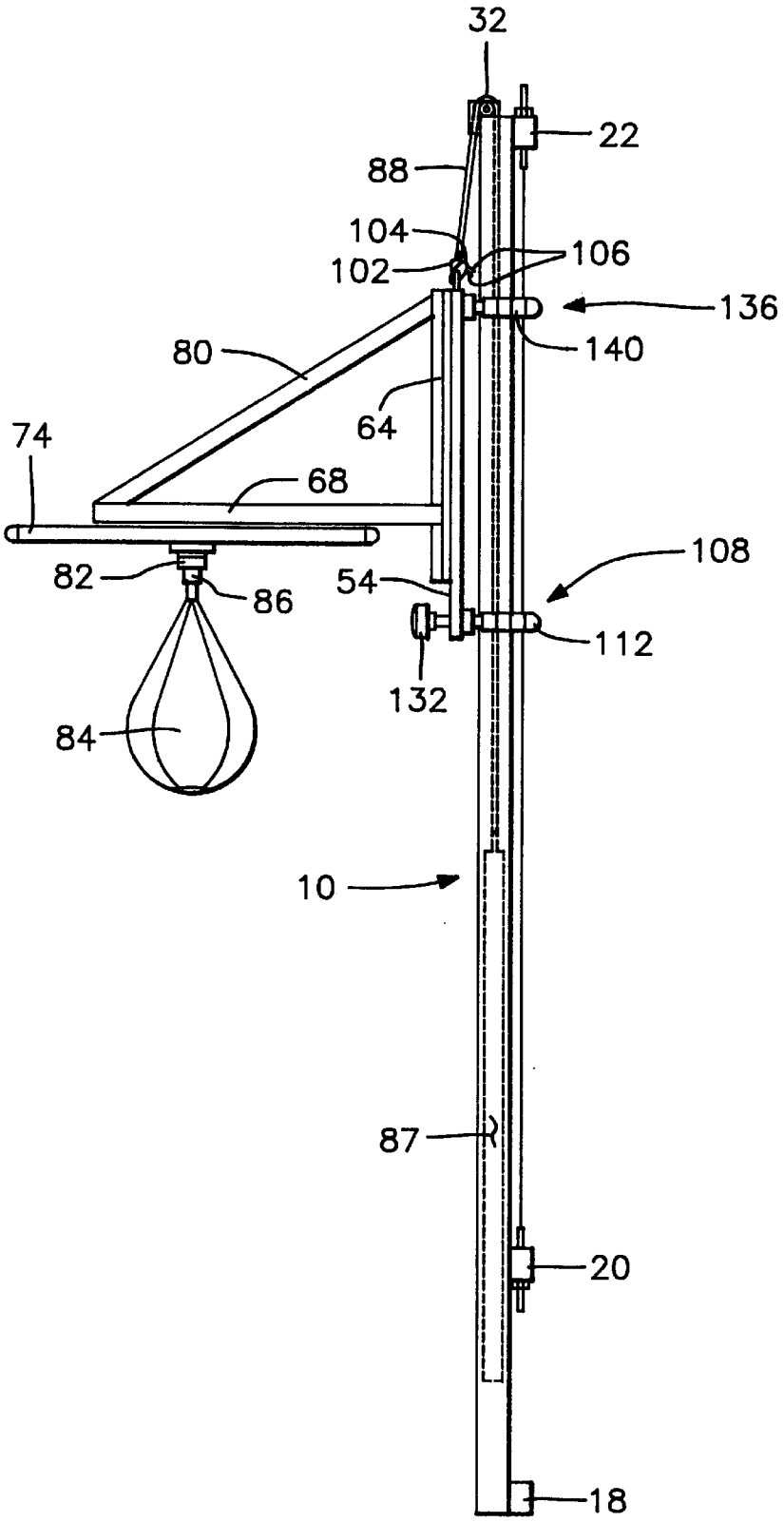
FIG. 2 is a side elevational side of the apparatus shown in FIG. 1.

With reference to the drawings, in general, and to FIGS. 1 and 2, in particular, a quick change adjustable speed bag embodying the teachings of the subject invention is generally designated as 10. With reference to its orientation in FIG. 1, the quick change adjustable speed bag 10 includes a vertical main frame unit 12, a striking bag carriage assembly 14 and a striking bag platform assembly 16.

The main frame unit 12 includes three horizontally oriented and vertically spaced brackets 18, 20 and 22 made of rectangular tubes. Bracket 18 is positioned at floor level. Each of the tubes includes holes 26 for securing the brackets to a vertical wall having studs located at sixteen inch centers. Holes 24 are for securing the brackets to studs spaced on twenty four inch centers.

Included in the frame unit 12 are two vertically extending cylindrical tubes 28. The tubes 28 extend between and are secured to brackets 18, 20 and 22.

Figure 3:
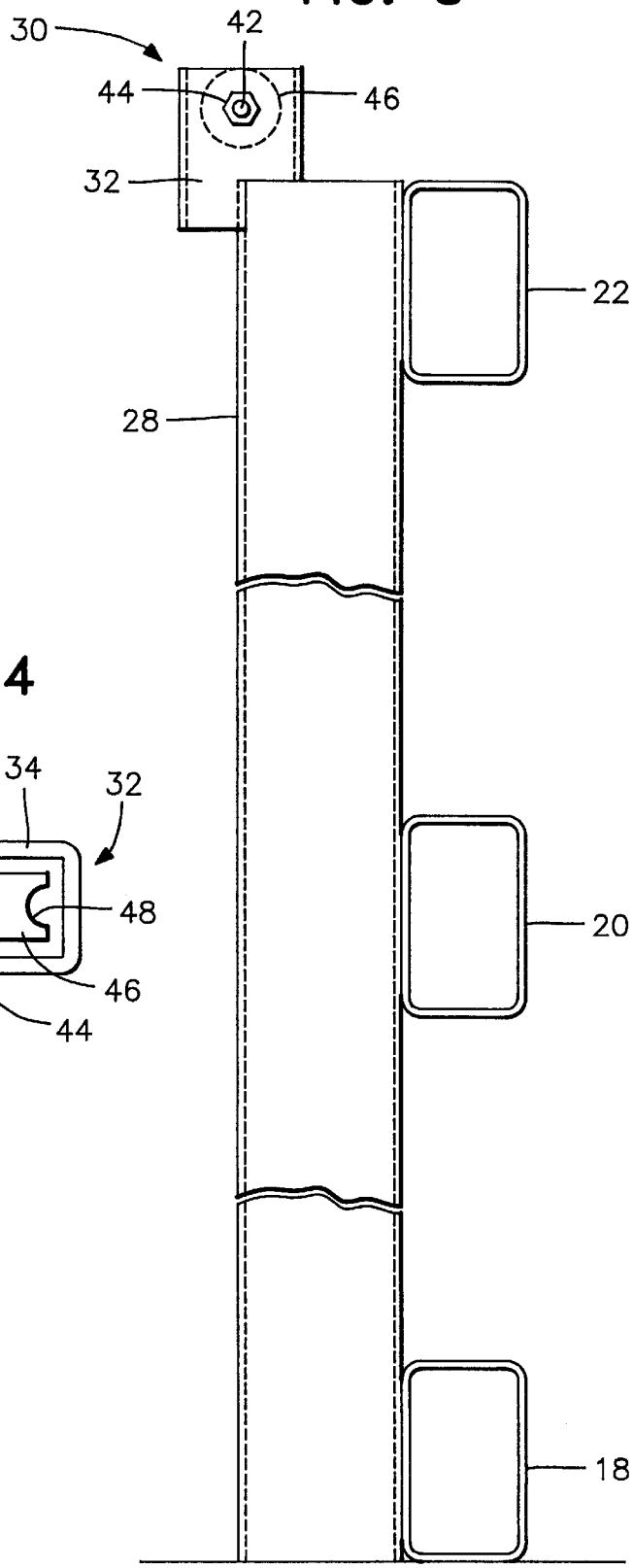
FIG. 3 is a detailed view of the vertical main frame which attaches to a vertical wall and on which the striking bag assembly is mounted.
Figure 4:
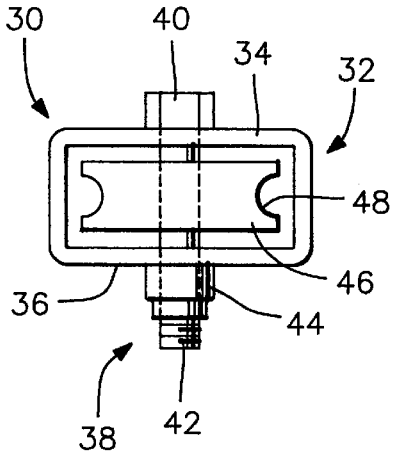
FIG. 4 is a further detailed view of the pulley assembly for the cable attached to the striking bag carriage assembly and the counter weight inside of the vertical main frame.

With reference to FIGS. 3 and 4, at the top of each of the tubes 28 is a pulley assembly 30. The pulley assembly includes a section of rectangular-shaped tubing 32 through which extends, through opposite side walls 34, 36, a bolt 38 having head 40 and threaded end 42 onto which is secured a nut 44. Located within the interior of the tube section 32 is a pulley 46 rotatably mounted on the shaft of the bolt 38. The pulley includes an arcuate groove 48 for receipt of a steel cable.

Figure 5:
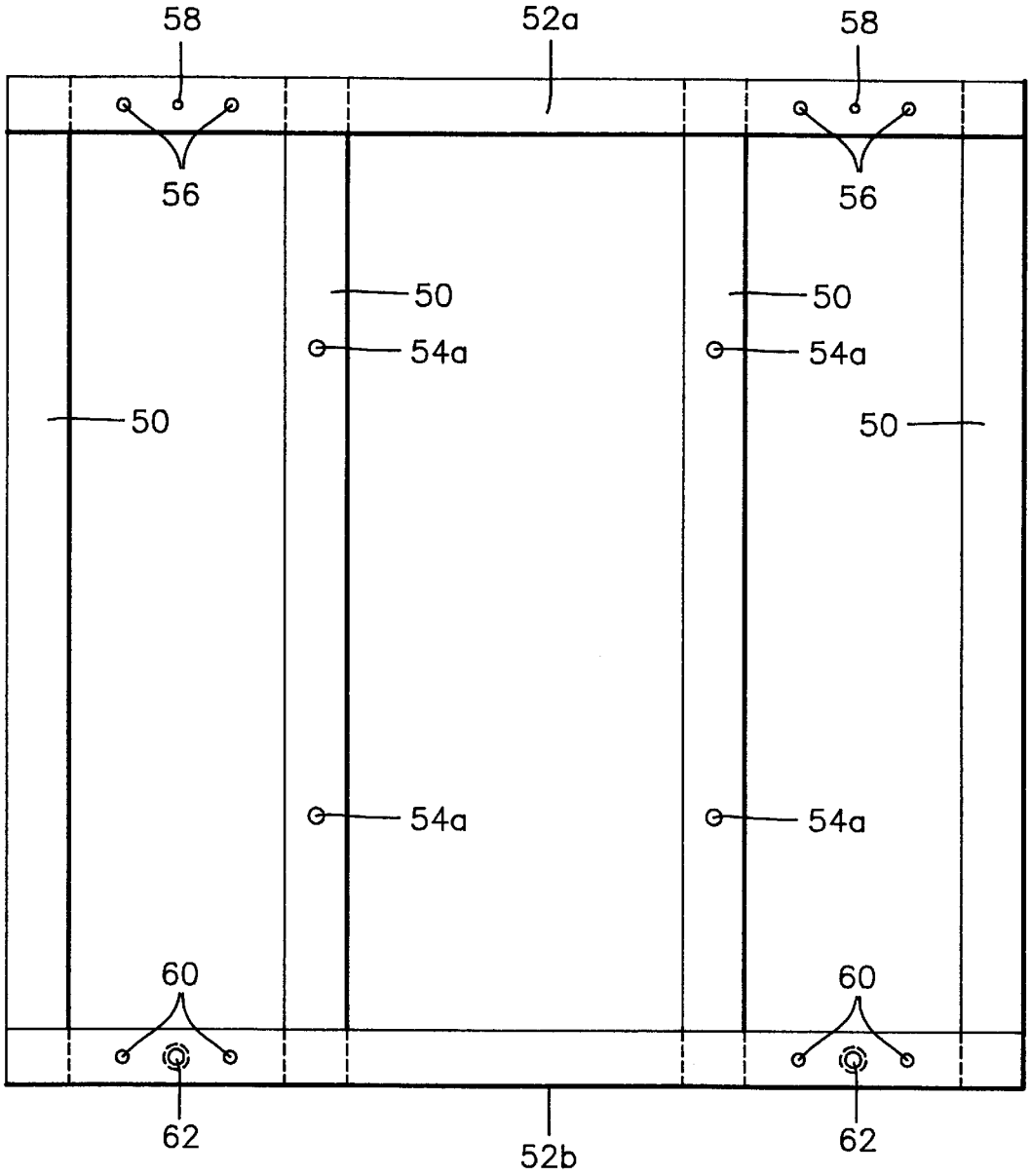
FIG. 5 is a rear view of the carriage frame on which the striking bag platform and bearing and lock assemblies are mounted.
Figure 6:
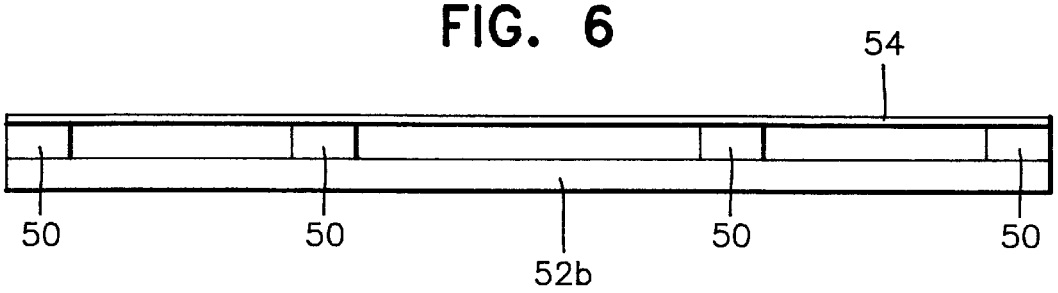
FIG. 6 is a bottom view of the carriage frame.

In FIGS. 5 and 6, the striking bag carriage assembly 14 is shown as including four rectangular-shaped tubes 50 interconnected and welded to rectangular-shaped cross-pieces 52*a* and 52*b*. Secured to an exterior surface of the tubes 50, is a rigid plastic surface plate 54. The two inner tubes 50 include holes 54*a* for mounting of brackets 64 and plate 54.

The upper cross-brace 52*a* includes two sets of two holes 56 for securing a bearing assembly to the top of the striking bag carriage assembly. Located between the pairs of holes 56 is a pilot hole 58. In the lower cross-brace 52*b* are two sets of bolt holes 60 with a central bolt hole 62 located between each pair of holes 60.

Figure 8:
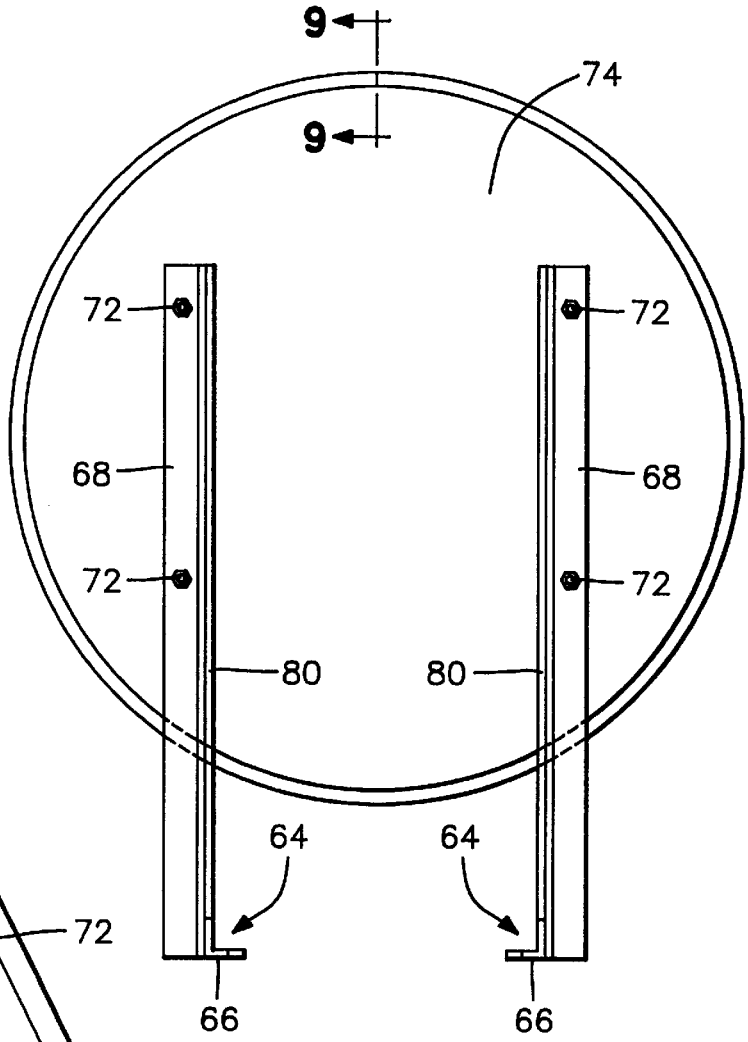
FIG. 8 is a top plan view of the striking bag assembly.
Figure 7:
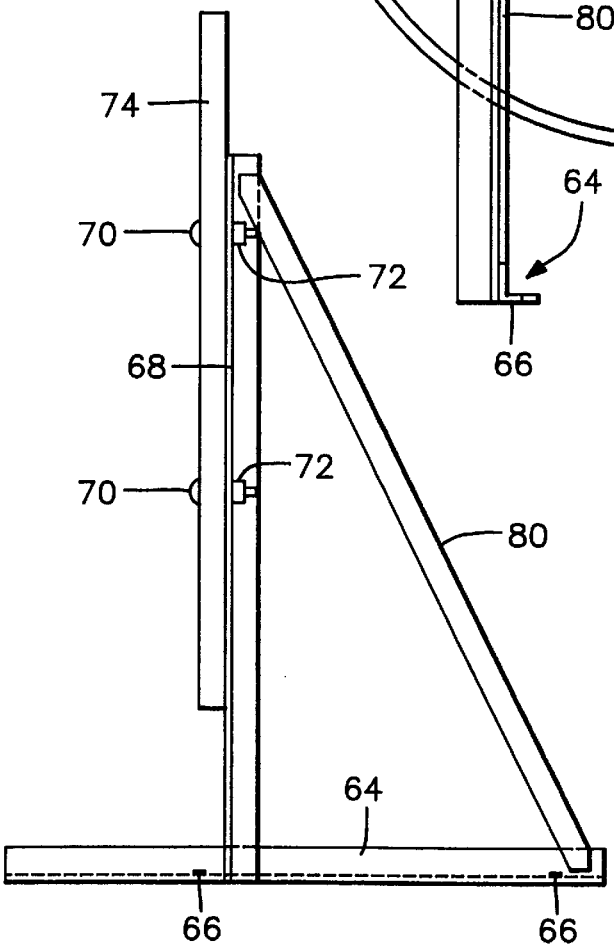
FIG. 7 is side view of the striking bag platform assembly.
Figure 9:
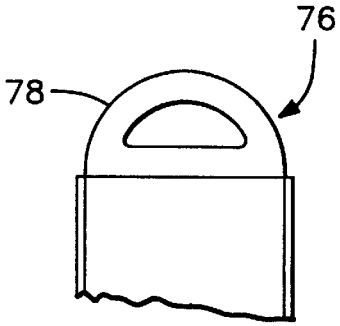
FIG. 9 is a sectional view taken along line 9—9 of FIG. 8.

In FIGS. 7 through 9, the details of the striking bag platform assembly 16 are shown. Two angle iron brackets 64, extend vertically and are secured through holes 66 and through plate 54 to inner tube 58. Extending horizontally from the brackets 64 are angle iron brackets 68 which are connected through a flange by bolts 70 and nuts 72 to circular striking bag platform 74. The bolts which secure the brackets 64 to the plate 54 extend through bolt holes 54*a* in the brackets 50.

Platform 74 includes semi-circular protective edging 76, as shown in FIG. 9, having an outer lip 78 of a compressible material. To complete the striking bag platform assembly, diagonally-extending bars 80 interconnect the brackets 64 and 68 for strength and stability.

As shown in FIGS. 1 and 2, the striking bag platform 74 includes a mounting bracket 82 to which is connected a striking bag 84 by a pivot connection 86. The bag 84 is free to move in all directions on pivot connection 86.

To raise and lower the striking bag carriage assembly 14, a counterweight 87 is slidably mounted in each of the tubes 28. The two counterweights approximate the weight of the striking bag carriage assembly 14 and striking bag platform assembly 16 so that when the carriage assembly is manually moved, it will remain at the position to which is manually moved upon release of further manual movement.

Figure 12:
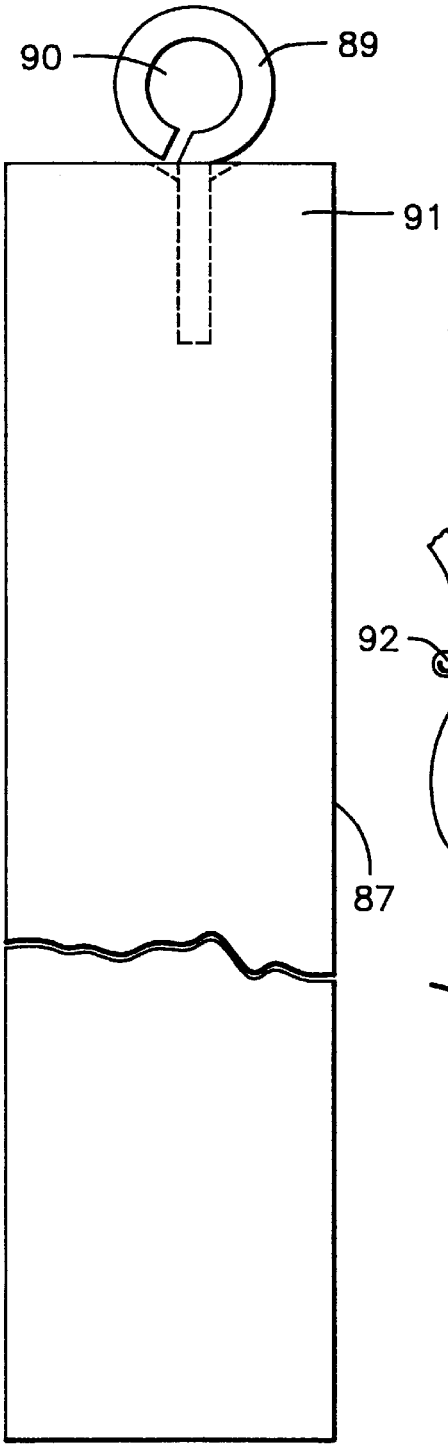
FIG. 12 is a front view of one of two counterweights which are enclosed within the cylindrical tubing of the main frame unit.
Figure 13:
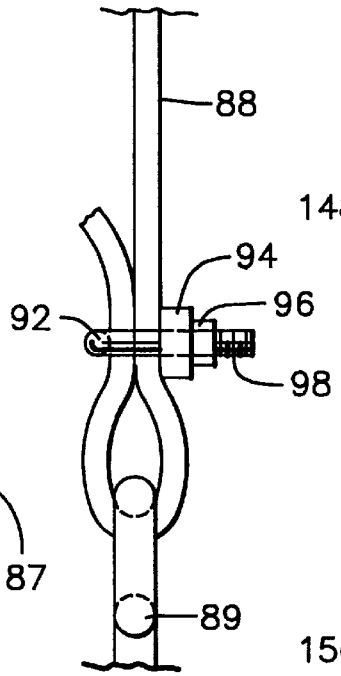
FIG. 13 is a side view of the attachment of a screw eye of a counterweight to a lifting cable.

The counterweights 87 each include a screw eye 89 secured at an upper end 91. A cable 88 is connected to the screw eye 89 by passing an end of the cable through the opening 90 of the screw eye, as shown in FIGS. 12 and 13, and securing it to itself by a U-shaped clamp bar 92 encircling two portions of the cable 88. A crossbar 94, having two holes positioned over the ends of bar 92, is moved into engagement with the cable by the rotation of a nut 96 at both of the threaded ends 98 of the U-shaped clamp 92.

The cable 88 extends from the upper end 86 of the counterweight, up out of the tubes 28 and around the pulleys 46 as received in the groove 48 of each pulley. The other end of the cable is secured to a screw eye 100 located in the top cross-piece 52*a* of the carriage assembly 14. As with the securing of the end of the cable to the counterweight, a U-shaped clamp bar 102 having a cross-piece 104 includes nuts secured onto the ends 106 of the U-shaped clamp 102 to fix the cable to the carriage assembly.

Figure 12A:
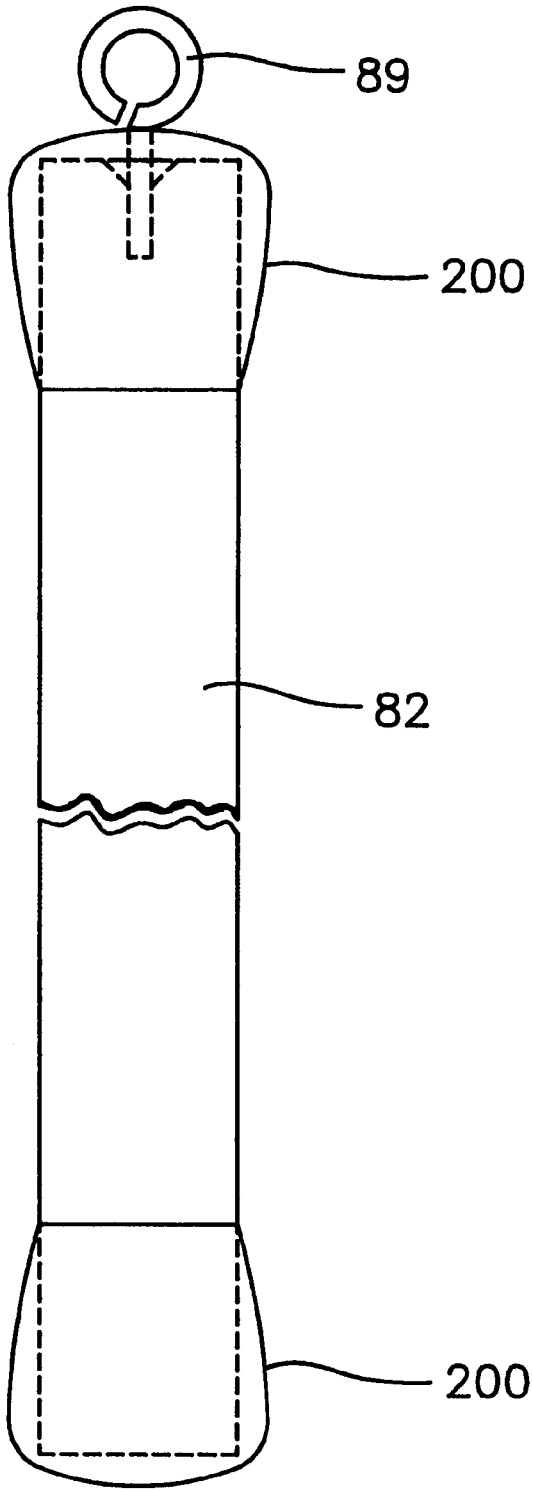
FIG. 12A is a detailed view of the counterweight shown in FIG. 12 with a plastic cap or coating on the opposite ends of the counterweight.

As shown in FIG. 12A, the ends of the counterweight 82 may include a plastic cap or coating 200. The caps 200 reduce the spacing between the exterior of the counterweight and the interior of the tube within which the counterweight slides. This will reduce the noise and vibration caused by the counterweight moving through its tube as the height of the carriage assembly is adjusted.

Figure 10:
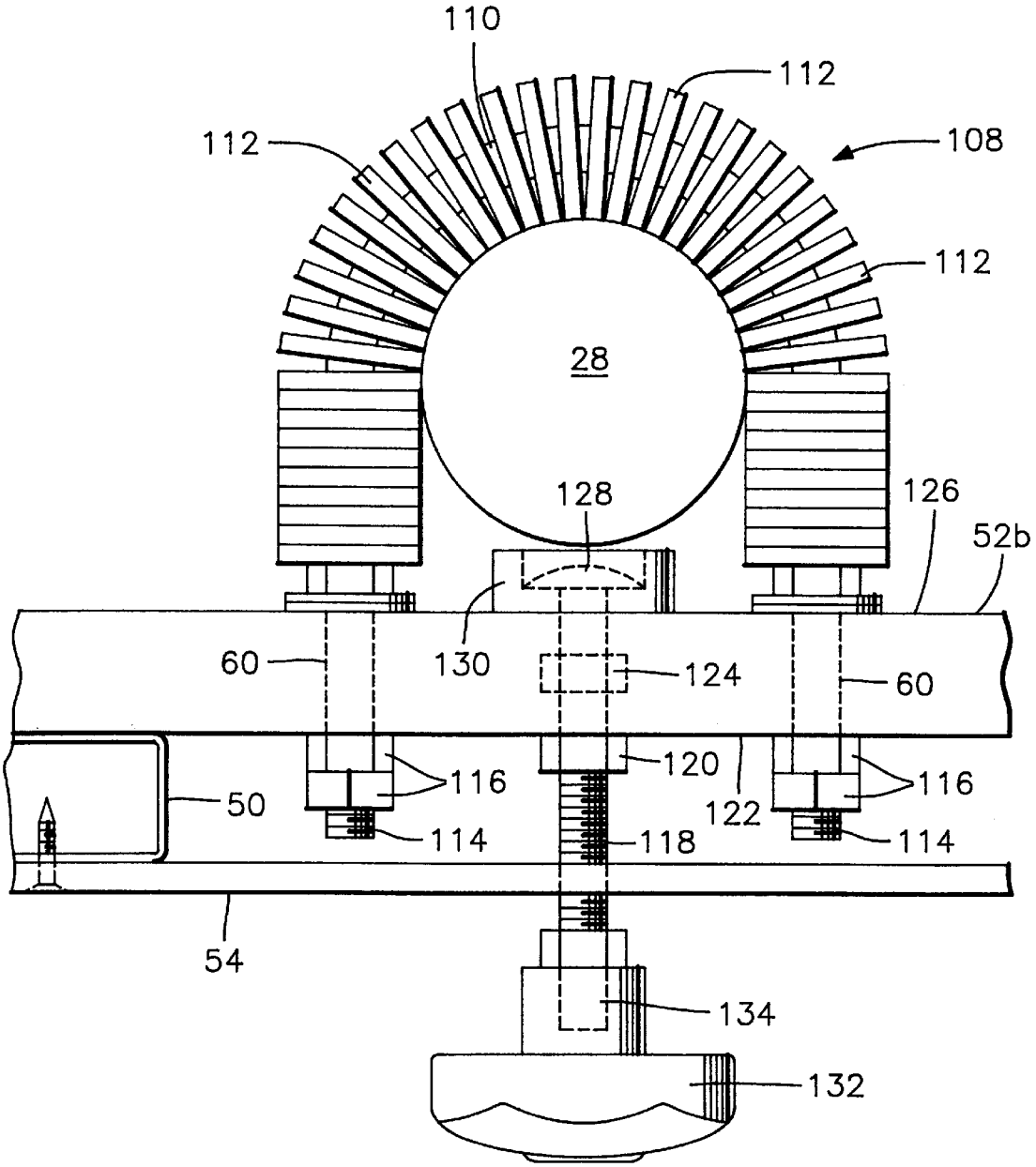
FIG. 10 is a detailed plan view of one of two lower bearing and stabilizer locks extending from the striking bag carriage assembly and surrounding a vertically extending cylindrical tube.

As a safety precaution, two bearing and lock assemblies 108, as singularly shown in FIG. 10, are located extending from cross-piece 52*b* for fixing the platform assembly 16 at a predetermined position. Each bearing and lock assembly 108 includes a U-shaped rod 110 onto which is mounted a plurality of nylon roller bearings 112 which surround the exterior surface of cylindrical tube 28. The opposite ends 114 of the rod 110 pass through the bolt holes 60 in the cross-brace 52*b* and are secured in place by lock nuts 116. Located in between the ends 114 of the rod 110 is a bolt 118 which extends through a nut 120 welded on the surface 122 of bottom cross-piece 52*b*. The bolt passes through internal limit nut 124 until passing through the surface 126 of cross-piece 52*b*. The head 128 of the bolt is embedded in a bearing pad 130.

Upon rotation of knob 132 mounted on opposite end 134 of bolt 118, the bearing pad 130 is either moved towards or away from the cylindrical tube 28. Upon engagement of the pad 130 with the tube 28, the position of the carriage assembly 14 is locked. Similarly, upon opposite direction rotation of the knob 132, the bearing pad is backed away from the tube 28 so as to allow sliding movement of the carriage assembly 14 with respect to the tube as assisted by the nylon rollers 112 which surround and engage the tube 28.

Figure 10A:
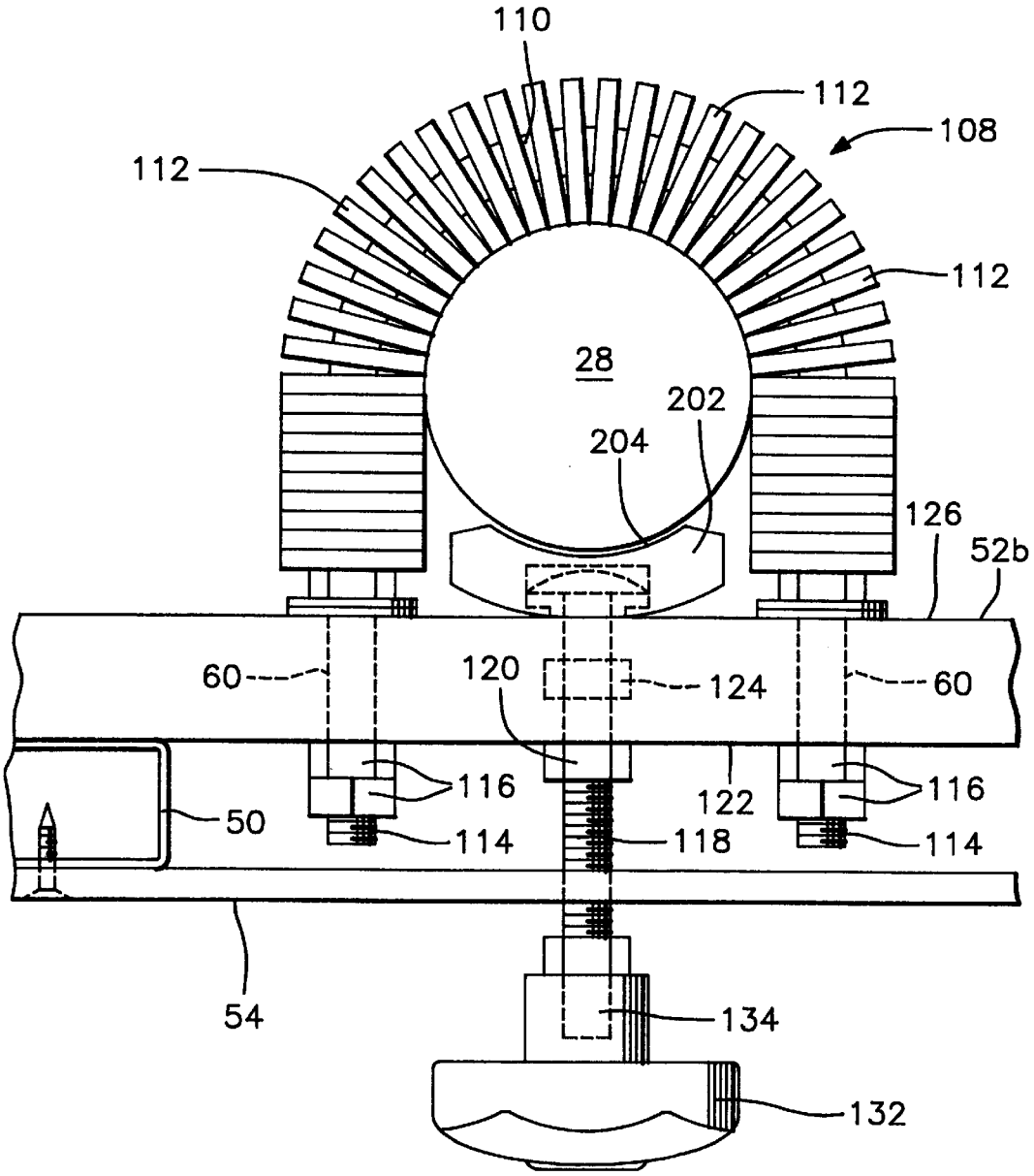
FIG. 10A is a detailed plan view of an alternative embodiment of a bearing and stabilizer lock with a brake pad having a surface shaped complementary to a cylindrical tube.
Figure 10B:
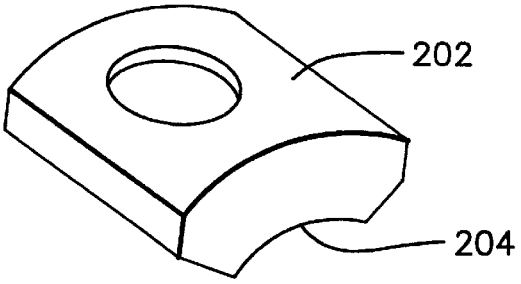
FIG. 10B is a perspective view of the brake pad of FIG. 10A.

In FIGS. 10A and 10B, a bearing or brake pad 202 is shaped so as to have a surface 204, which is shaped complementary to the shape of the tube 28. The complementary shaped surface 204 provides contact with the tube 28 over an increased size surface area. This ensures a secure locking of the position of the carriage assembly 14.

Figure 11:
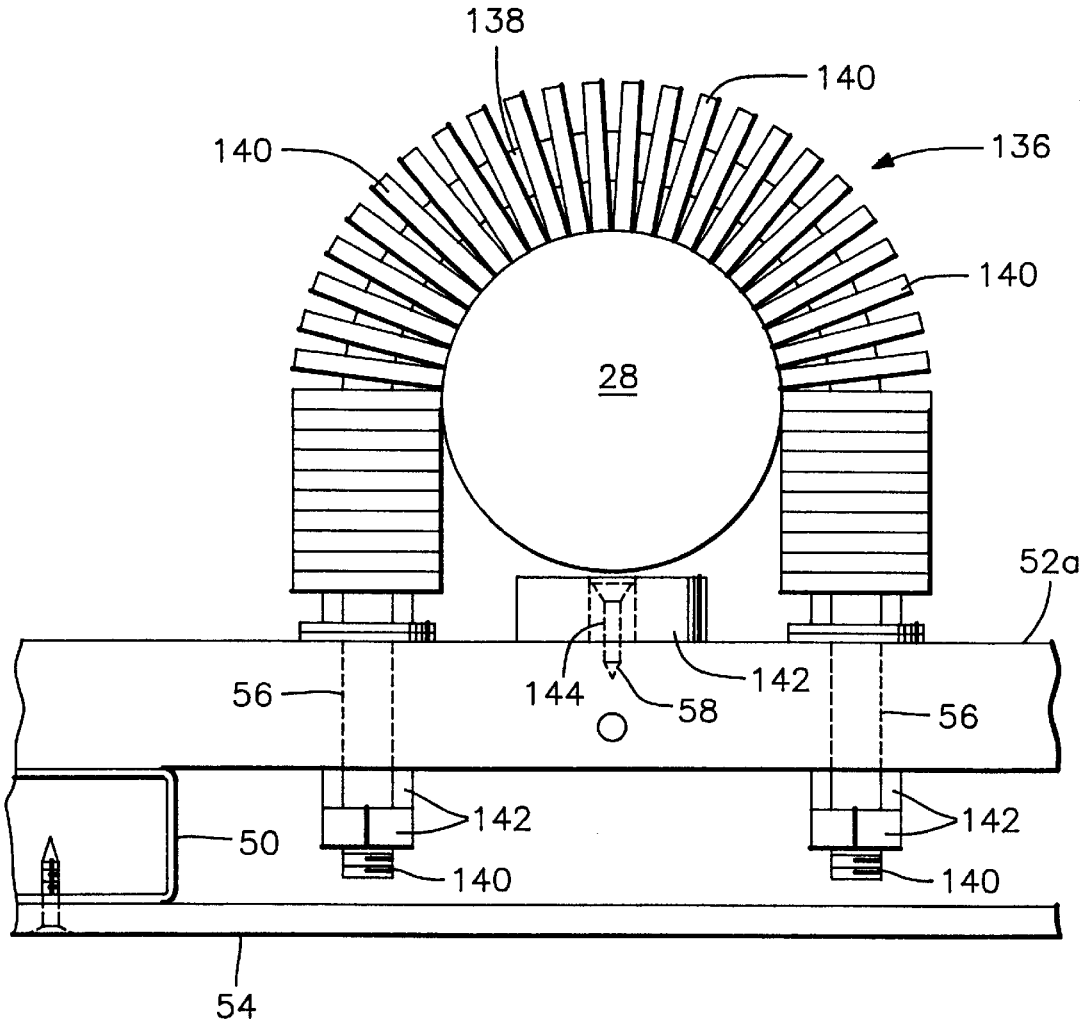
FIG. 11 is a detailed plan view of one of two upper bearings extending from the striking bag carriage assembly and surrounding a vertically extending cylindrical tube.

As shown in FIG. 11, one of the two bearing assemblies 136 is shown which are located secured to the upper cross-piece 52*a* of the carriage assembly 14. In this assembly, a U-shaped rod 138 has opposite ends 140 which extend through holes 56 in the cross-piece 52*a*. The ends 140 are secured in place by lock nuts 142. Rotatably mounted on the rod 138 are a plurality of nylon roller bearings 140 which assist in the moving of the carriage assembly 14 along the length of tubes 28.

A bearing pad 142 is secured in place by a screw 144 extending into pilot hole 58. The bearing pad 142 is normally spaced away from the tube 28 at a slight distance so that upon drawing of the bottom of the carriage assembly 14 towards the tubes 28 by the bearing and lock assemblies 108, a lowermost edge of the bearing pad 142 slightly engages the peripheral edge of the tube 28 to assist in maintaining the fixed position of the carriage assembly. Upon release of the bearing and latch assemblies 108 from the fixed position for the carriage assembly 14, the orientation of the carriage assembly 14 will be shifted slightly so as to provide clearance between the bearing pads 142 and the tubes 28 to facilitate sliding movement of the carriage assembly through the system of guide cables 88 and counterweights 82.

Figure 14:
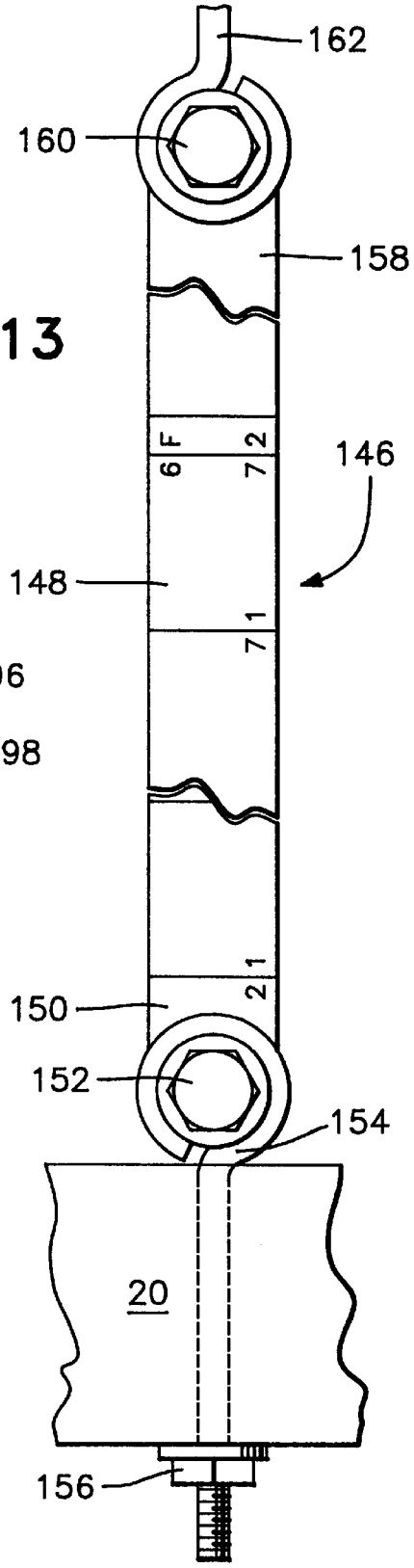
FIG. 14 shows a front view of the mounting of the elevation height scale between horizontally extending rectangular tubing brackets of the main frame unit.

To assist in returning the carriage assembly to a specific location for a particular individual, a height scale assembly 146 as shown in FIGS. 1 and 14, includes a height scale tape 148 which at a lower end 150 is secured by a bolt 152 passing through the opening of an eye hook 154 secured to bracket 20 by nut 156. At the opposite end 158 of the tape 148, a bolt 160 passing through the scale 158 and the opening of an eye hook 162, secures the scale in position. Eye hook 162 extends through bracket 22 and is held in position by a nut 164.

By aligning a bottom edge of the carriage assembly 14 with a measurement on the tape 148, an exact repositioning of the carriage assembly to a predetermined height is possible. The carriage assembly can be moved from this position and returned to the exact same position by notation of the indicia on the tape 148.

Figure 15:
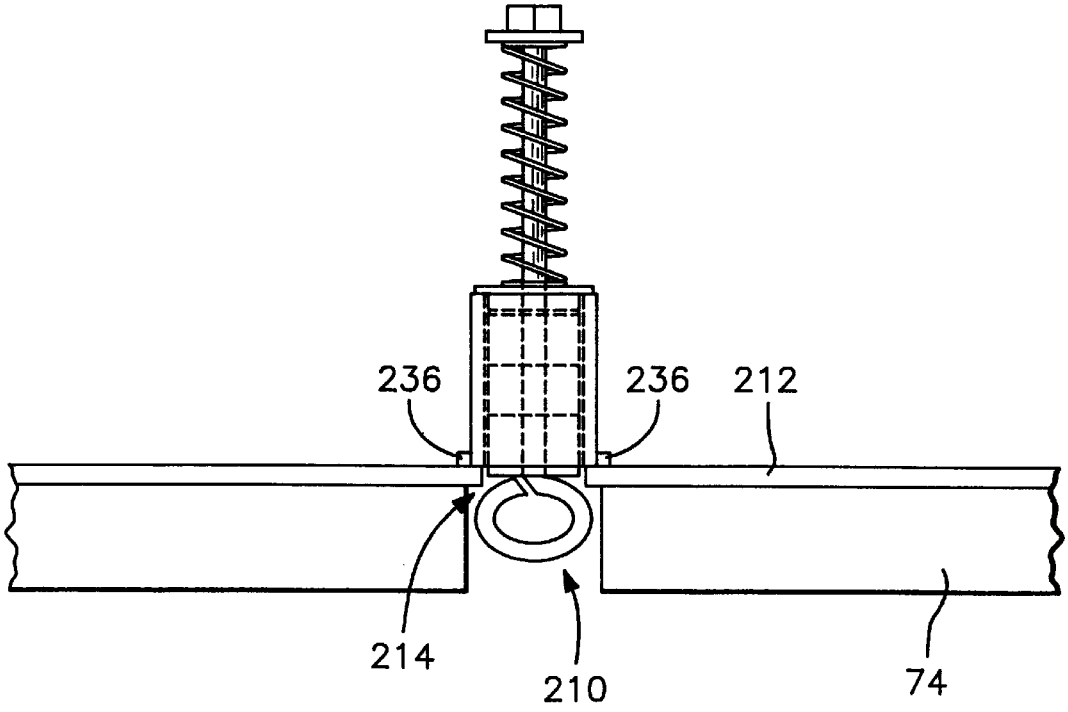
FIG. 15 is a side, partly sectional view of a heavy bag attachment shown in a relaxed state.
Figure 16:
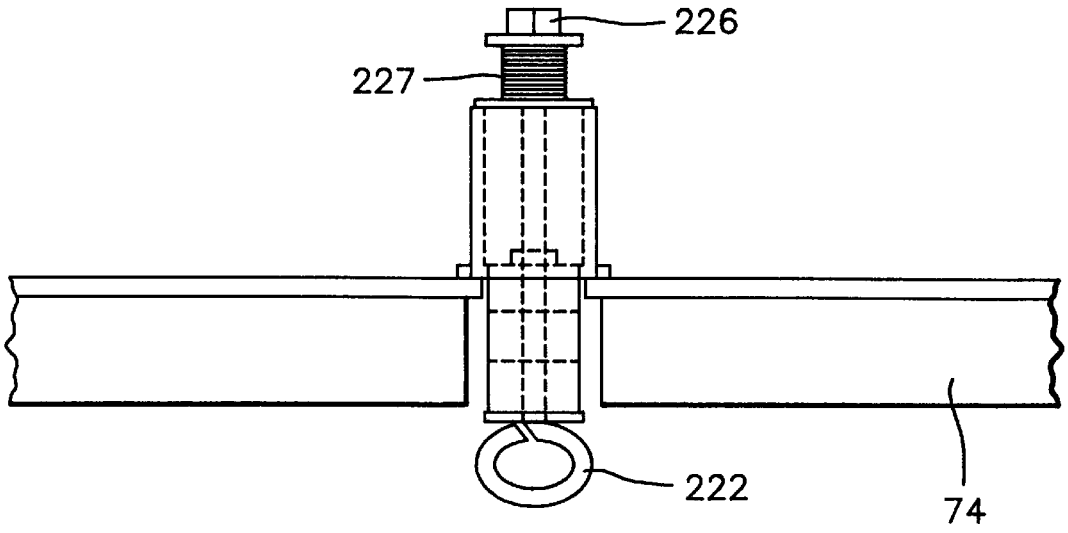
FIG. 16 is a side, partly sectional view of a heavy bag attachment shown in a compressed position so that an eye hook projects through an opening in the striking board for attachment of a heavy bag to a striking bag platform assembly.
Figure 17:
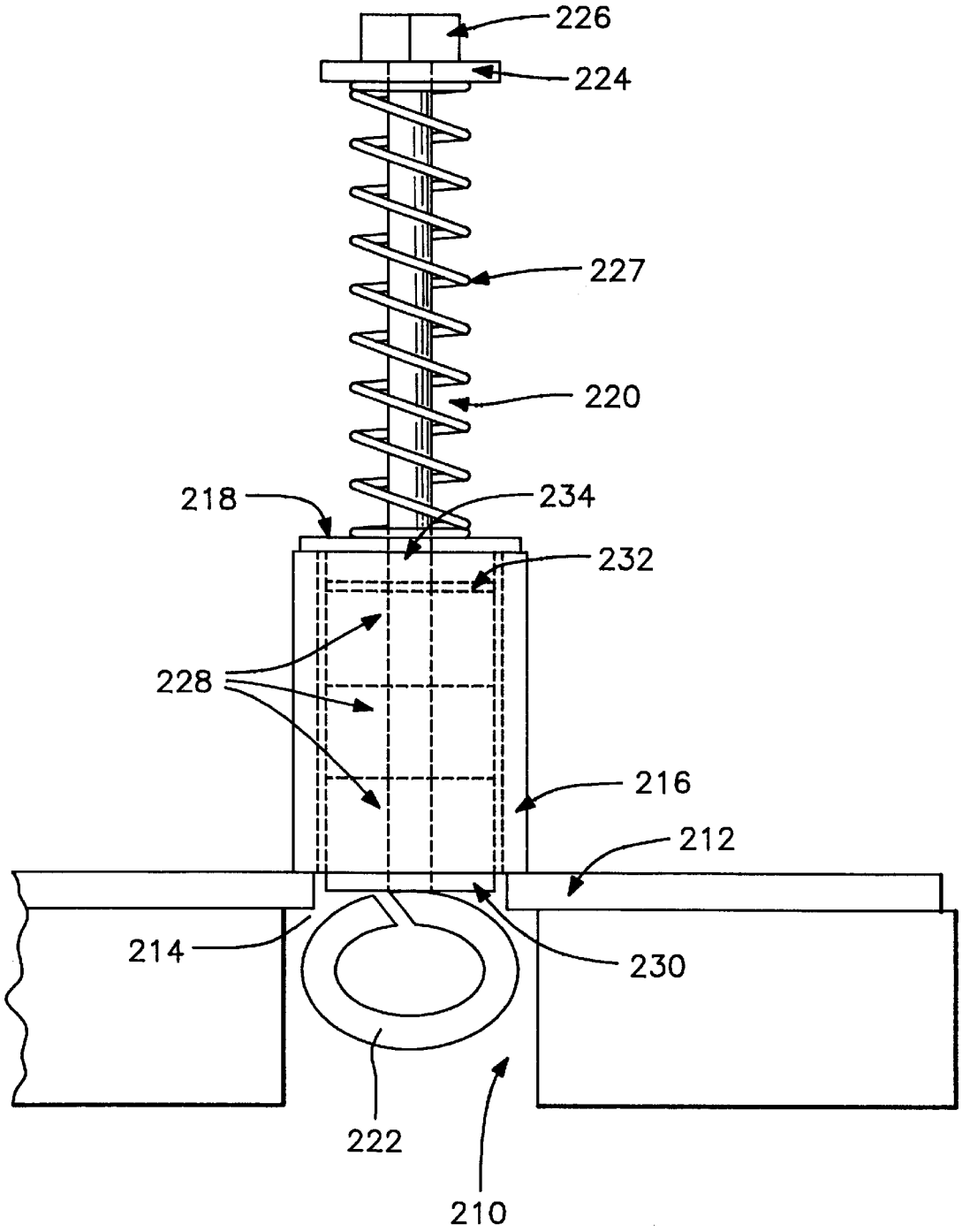
FIG. 17 is an enlarged, detailed view of the heavy bag attachment shown in FIG. 15.
Figure 18:
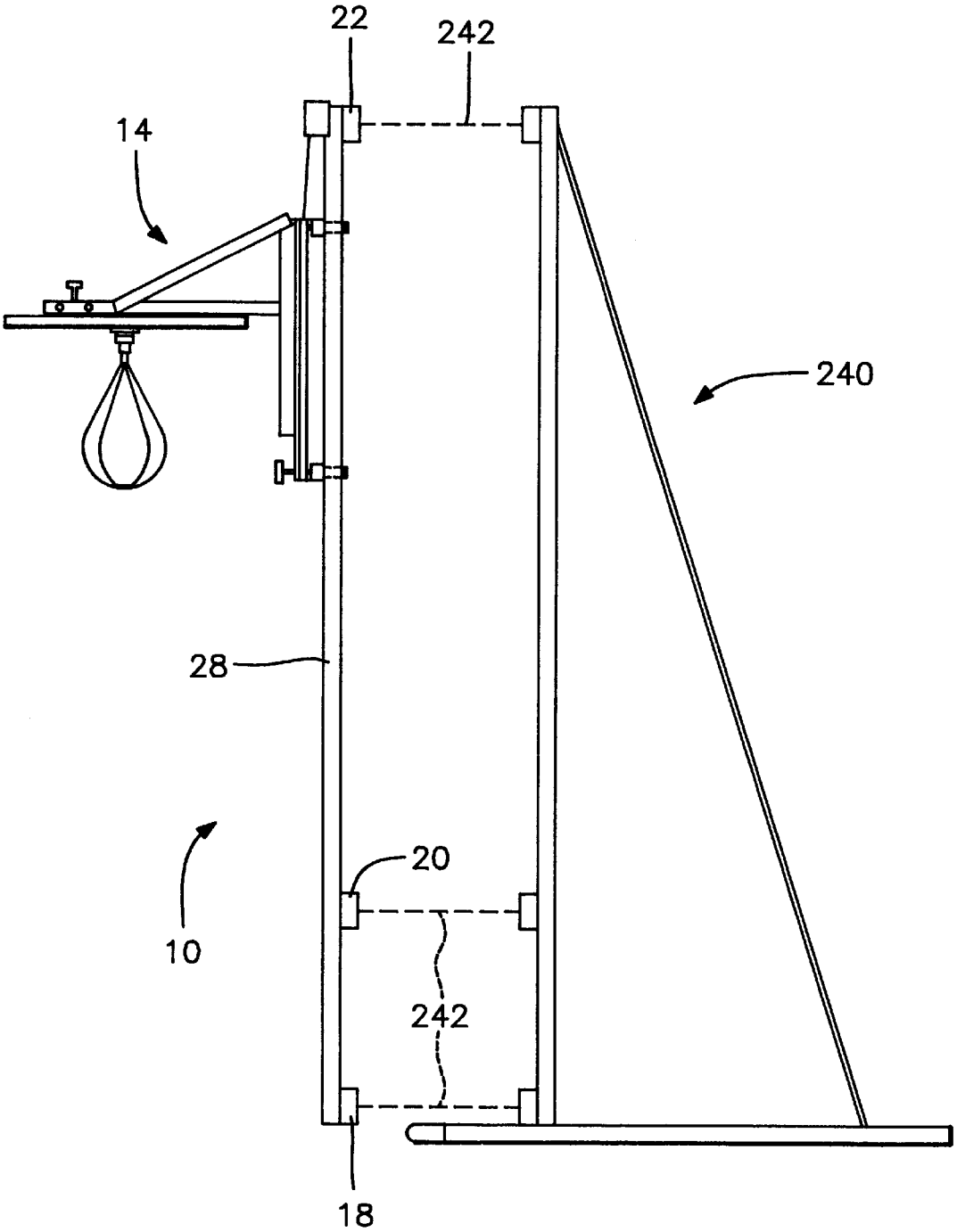
FIG. 18 is an exploded view showing a quick change adjustable speed bag spaced from a free standing frame unit.
Figure 27:
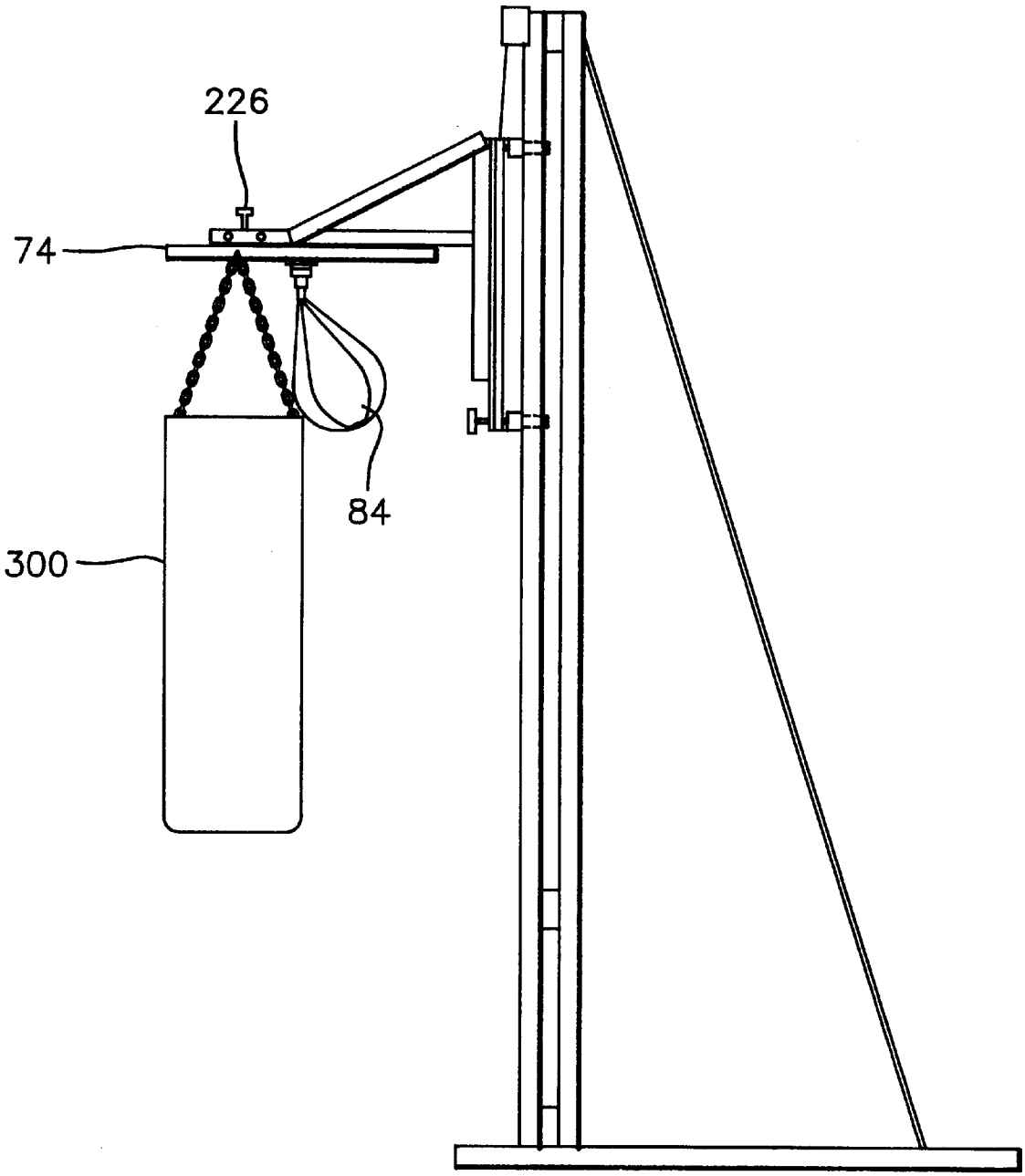
FIG. 27 is a side view of a speed bag and a heavy bag mounted on a free standing unit.
Figure 29:
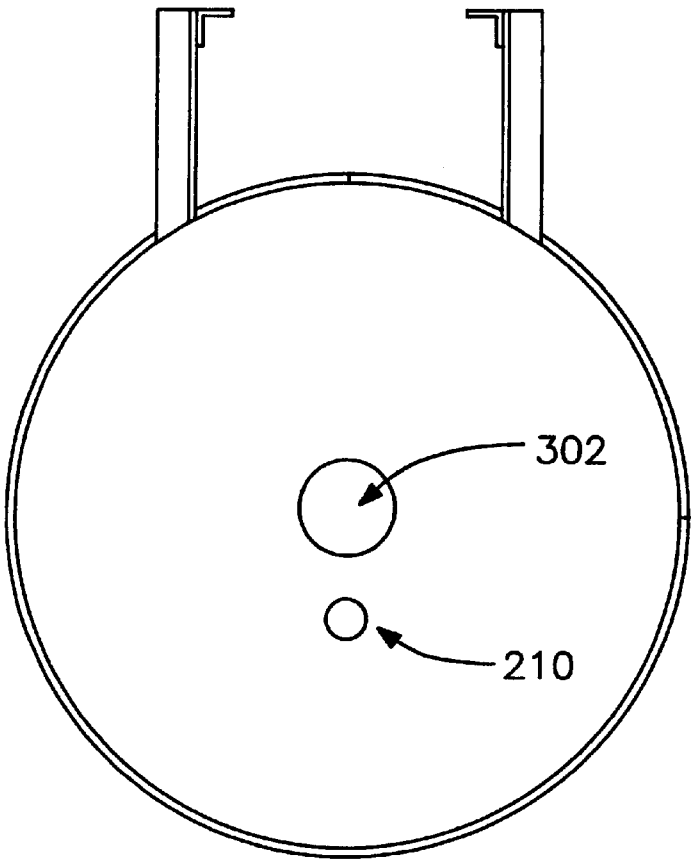
FIG. 29 is a bottom view of a striking bag platform.
Figure 28:
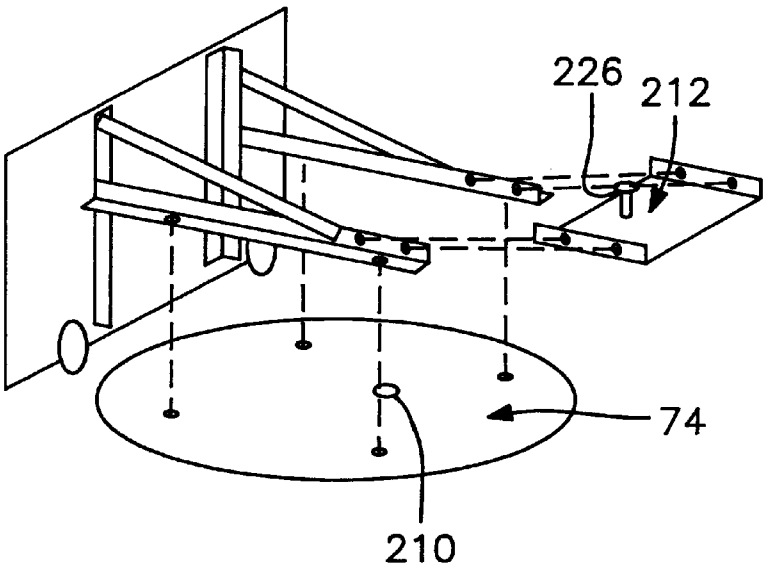
FIG. 28 is an exploded view of a heavy bag attachment spaced from a platform which is spaced from a bracket assembly.

In FIGS. 15 through 17, an optional feature of the present invention is shown. It is understood that this feature is used in combination with the striking bag platform 74 shown in FIG. 27 for holding an additional target, such as a heavy bag 300. This is accomplished by the use of a second hole 210 in the striking bag platform board 74, as shown in FIGS. 27 through 29.

By the arrangement shown in FIGS. 15 through 17, a second hole 210 (in addition to the swivel connection 302 for the speed bag) of approximately 1½ inch diameter is drilled through the striking board 74. On top of the striking board is positioned a flat steel mounting plate 212 having an opening 214 of approximately one inch diameter. On top of the plate 212 is placed a pipe 216 of approximately 1½ inch diameter.

A cap washer 218 is welded on top of an upper end of pipe 216. Extending through the pipe 216 and cap washer 218 is a ¼ inch eye bolt 220, having eye hook 222 located at one end, and at an upper end, a fender washer 224 and a hex nut 226. Wrapped around the eye bolt 220, between the cap washer 218 and the bender washer 224, is a tension spring 227.

Inside of the pipe 216 are located three nylon bushings 228 which, at a lower end, engage a ¼ inch fender washer 230 and at an upper end engage a ¼ inch fender washer 232. Above washer 232 is located a ¼ inch hex nut 234 which limits the upward travel of the eye bolt 220.

The pipe 216 is secured by welds 236 to the upper surface of the plate 212. Accordingly, in FIGS. 15 and 17, the normal position of the eye bolt 220 is shown. The spring 226 biases the eye bolt so that the eye hook 222 is recessed within the opening 210. However, when a heavy bag is to be attached to the striking board 74, the hex nut 226 is manually depressed against the force of the tension spring 227 so as to force the eye hook 222 down below the lower surface of the striking board 74 through hole 210.

In addition, the entire carriage assembly 14 may be lowered so that when the eye bolt 220 is in the extended position, as shown in FIG. 16, the eye hook 222 may engage a hook on top of the heavy bag with the heavy bag positioned on the ground. When the hook of the heavy bag is secured to the eye hook 222, the weight of the heavy bag will retain the eye bolt 220 in the position shown in FIG. 16.

The carriage assembly 14 may be then raised to a desired height and fixed in location by the locking devices shown in FIGS. 10, 10A and 11. The present invention may then be used for practice of striking and kicking with a heavy bag.

In an alternative embodiment of the present invention, as shown in FIGS. 18 through 26, the carriage assembly 14 and tubes 28 are mounted on and interconnected by brackets 18, 20, 22, as shown in FIG. 1, to a free standing, portable frame unit 240. The mounting on the frame unit 240 is shown in dotted lines 242 in FIG. 18.

Figure 19:
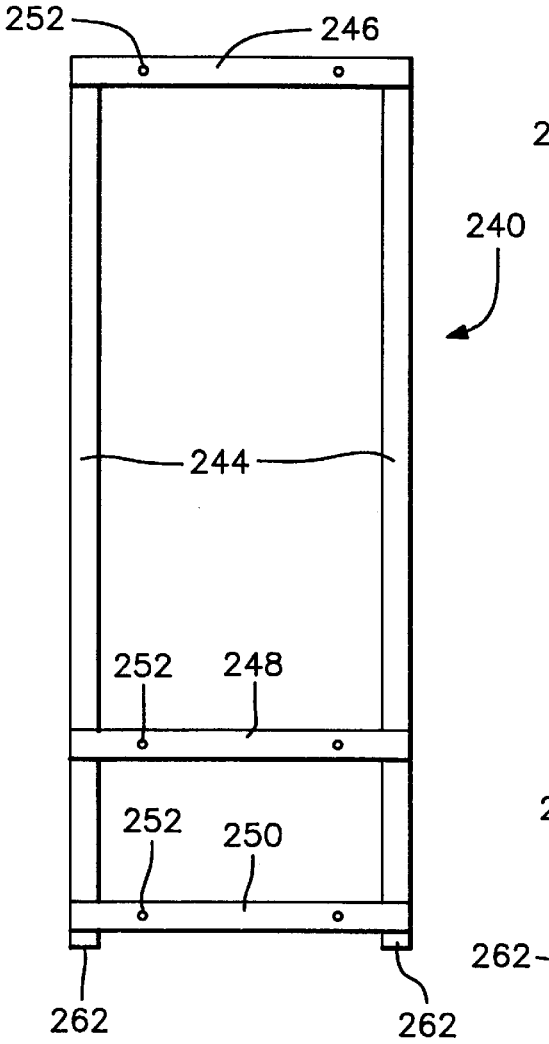
FIG. 19 is a front view of the free standing frame unit.
Figure 20:
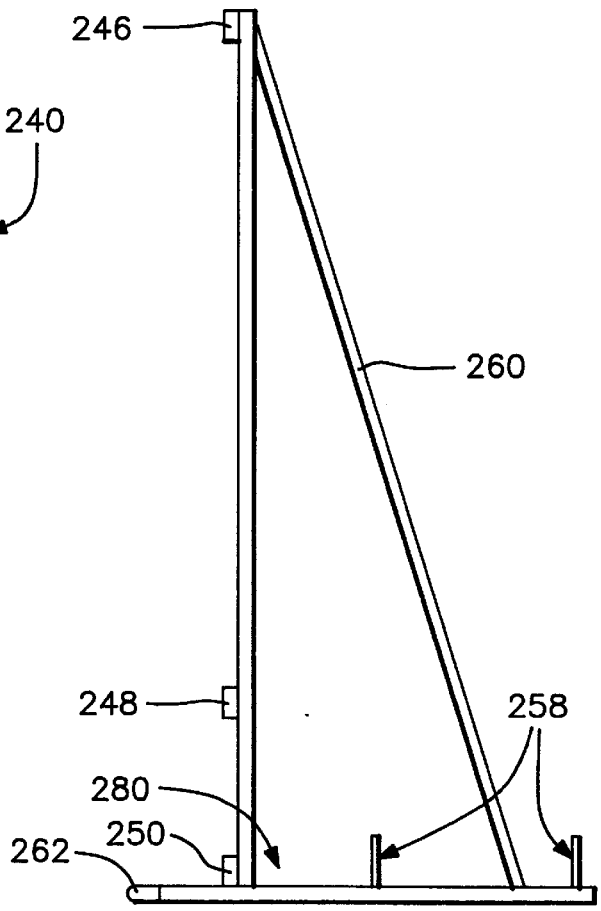
FIG. 20 is a side view of the free standing frame unit.
Figure 21:
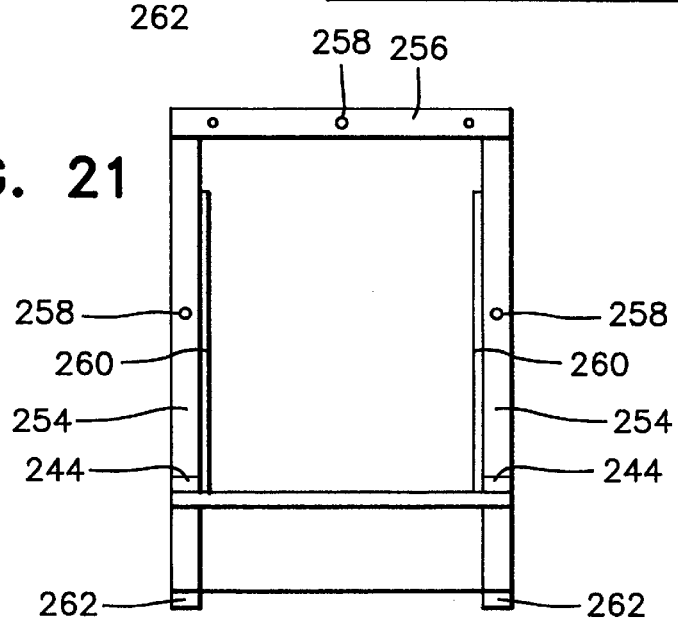
FIG. 21 is a plan view of the free standing frame unit.
Figure 22:
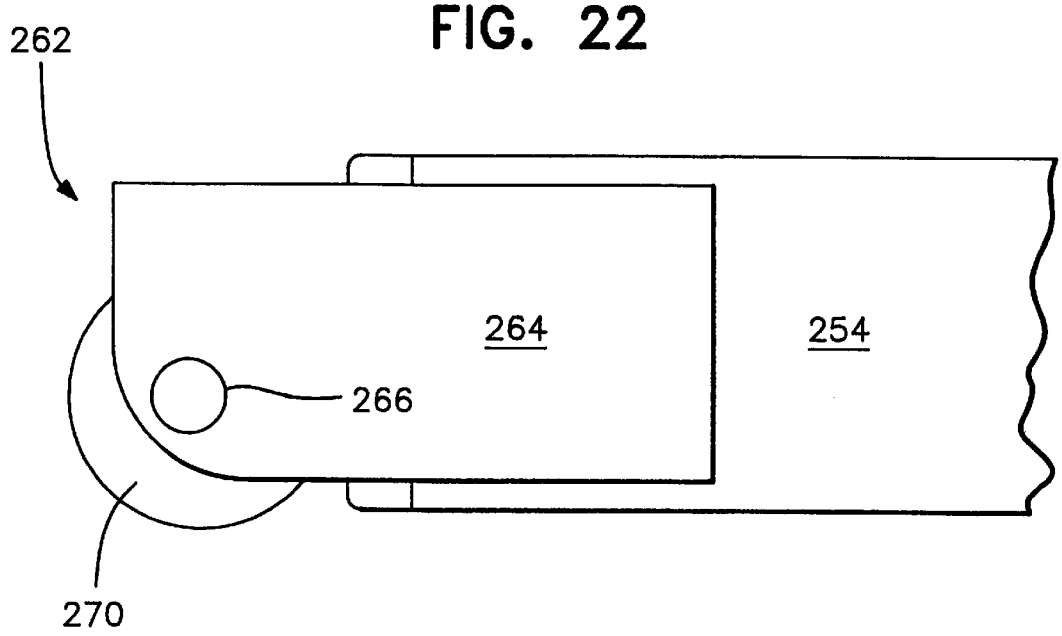
FIG. 22 is an enlarged detailed view of the roller assembly mounted at the front of the legs of the free standing frame unit.
Figure 23:
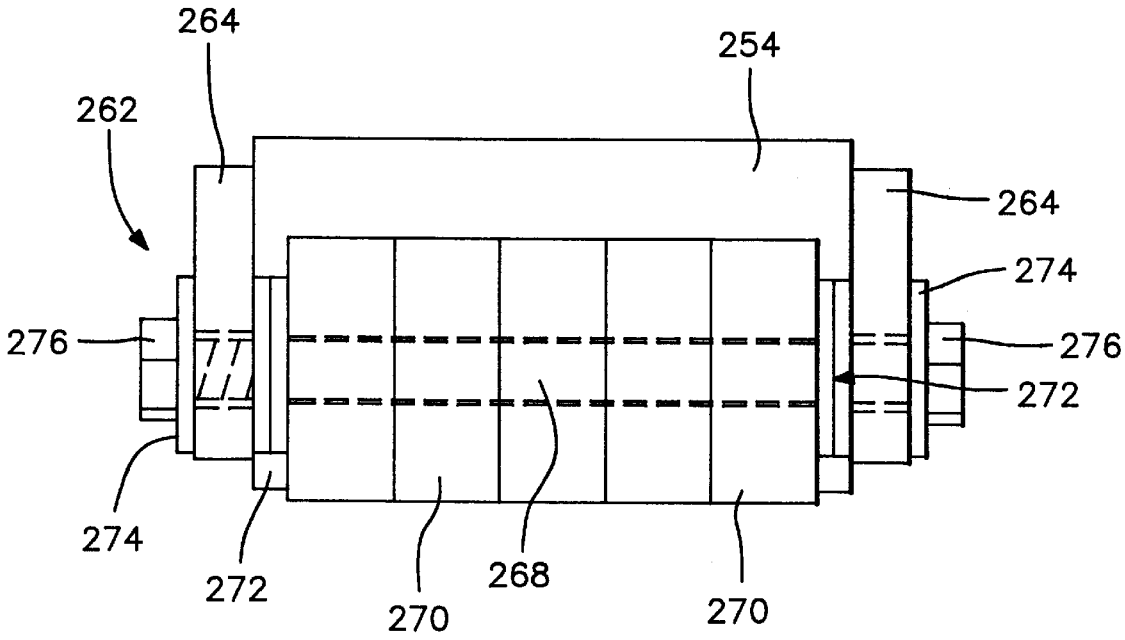
FIG. 23 is a front view of the roller assembly shown in FIG. 22.
Figure 24:
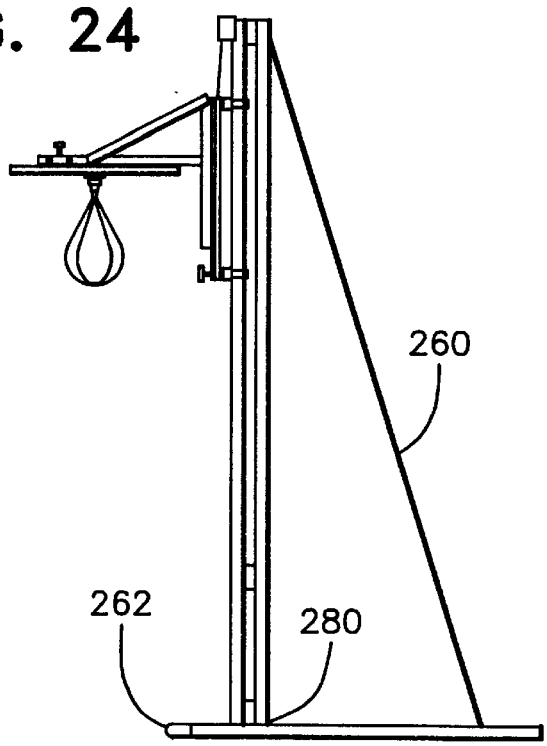
FIG. 24 is an assembled view of the quick change adjustable speed bag mounted on a free standing frame unit.

As shown in FIGS. 19 through 21, the frame unit 240, is made of two vertical steel posts 244 interconnected by brackets 246, 248 and 250. The brackets include mounting holes 252 for joining with the brackets 18, 20 and 22 as shown in FIG. 1. The vertical posts 244 are mounted on two horizontally extending posts 254 which are interconnected at a rear end by member 256. Mounted centrally on the posts 254 and the member 256 are vertically extending free weight posts 258. Interconnecting each pair of horizontal posts 254 and vertical posts 244 are removably mounted diagonal braces 260.

At a leading end of each of the horizontal posts 254 is a roller assembly 262. As shown in detail in FIGS. 22 and 23, the roller assemblies include two spaced plates 264 having a hole 266 for extension therethrough of an axle 268. Located on the axle 268 are a plurality of nylon bushings 270. Intermediate of the bushings 270 and the plate 264 are two fender washers 272 located at each axle end. On the opposite side of the plates 264 are washers 274 and finally a securing nut 276.

Figure 25:
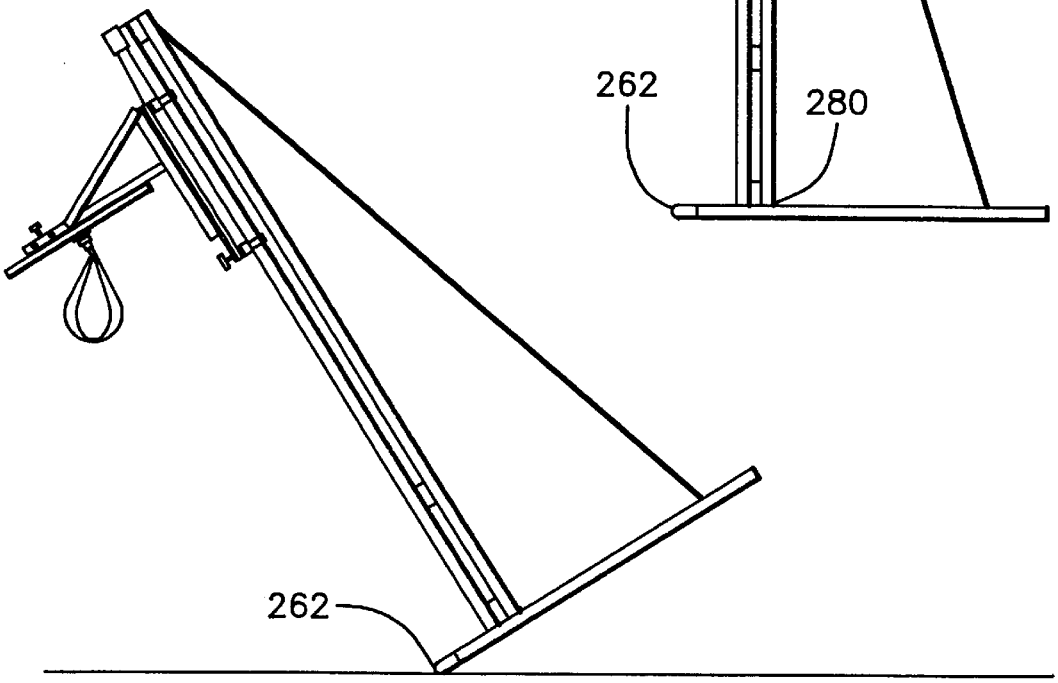
FIG. 25 illustrates the combination of the quick change adjustable speed bag mounted on a free standing frame unit which is rollable across the floor to a different location.
Figure 26:
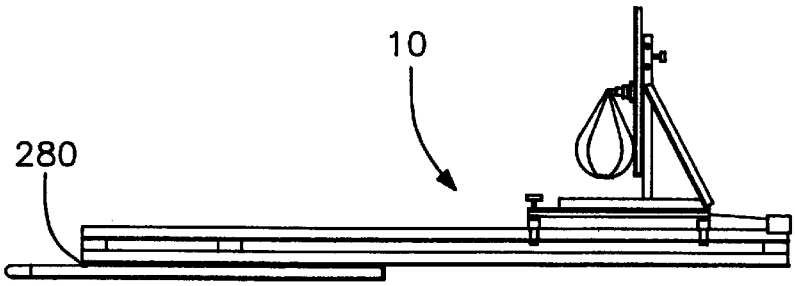
FIG. 26 illustrates the collapsability of the free standing frame unit for storage purposes.

Upon pivoting of the free standing frame unit 240 on the roller assemblies 262, the frame may be supported by the rollers 270 and moved to a different location as shown in FIG. 25. Also, by a hinge connection 280, interconnecting the horizontal post 254 and the vertical post 254, and the removal of diagonal braces 260, the frame unit may be folded down into the position shown in FIG. 26 so as to reduce the vertical space requirements necessary for storage of the frame and mounted assembly 10.

Having described the invention, many modifications thereto will become apparent to those skilled in the art to which it pertains without deviation from the spirit of the invention as defined by the scope of the appended claims.

I claim:

1. An adjustable height target assembly comprising:

a frame unit including two tubes, a carriage assembly slidably mounted on said two tubes, said carriage assembly including two cables secured to said carriage assembly at one end and secured at an opposite end to a counterweight slidably mounted within each of said two tubes, a bearing and locking assembly for engaging one of said tubes to lock a position of said carriage assembly, and a platform assembly mounted on said carriage assembly, said platform assembly including a connection for mounting a target on said platform assembly so as to practice hitting and kicking of the target, said connection being biased to be recessed in a hole of said platform assembly prior to mounting the target on said connection, said connection being movable with respect to said platform assembly for engaging with and being disengaged from the target.

2. An adjustable height target assembly according to claim 1, wherein said bearing and locking assembly includes a bearing pad for engaging and locking with said tube.

3. An adjustable height target assembly according to claim 2, wherein said bearing pad includes a surface shaped complementary to said tube.

4. An adjustable height target assembly according to claim 1, wherein said roller bearings are made of nylon.

5. An adjustable height target assembly according to claim 1, wherein said frame unit is mounted on a free standing frame.

6. An adjustable height target assembly according to claim 5, wherein said free standing frame is movable on rollers extending from one end of said free standing frame.

7. An adjustable height target assembly according to claim 5, wherein said free standing frame is foldable upon itself.

8. An adjustable height target assembly according to claim 1, wherein said connection includes a bias spring located above said platform assembly.

9. An adjustable height target assembly according to claim 8, wherein a plate reinforces said platform assembly for supporting said connection.

10. An adjustable height target assembly comprising a frame unit including two hollow tubes, a carriage unit slidable along and lockable to said tubes, a bearing and locking assembly for facilitating sliding and locking of said carriage assembly on said tubes, said bearing and locking assembly including a U-shaped rod extending through a plurality of roller bearings mounted on said U-shaped rod so that said roller bearings and said U-shaped rod surround and engage said tube, and a platform assembly mounted on said carriage assembly, said platform assembly including a connection for mounting a target on said platform assembly so as to practice hitting and kicking of the target.

11. An adjustable height target assembly according to claim 10, wherein said bearing and locking assembly includes a bearing pad for engaging and locking with said tube.

12. An adjustable height target assembly according to claim 11, wherein said bearing pad includes a surface shaped complementary to said tube.

13. An adjustable height target assembly according to claim 10, wherein said frame unit is mounted on a free standing frame.

14. An adjustable height target assembly according to claim 13, wherein said free standing frame is movable on rollers extending from one end of said free standing frame.

15. An adjustable height target assembly according to claim 13, wherein said free standing frame is foldable upon itself.

16. An adjustable height target assembly according to claim 10, wherein said connection is biased to be recessed in a hole of said platform assembly.

17. An adjustable height target assembly according to claim 16, wherein said connection includes a bias spring located above said platform assembly.

18. An adjustable height target assembly according to claim 17, wherein a plate reinforces said platform assembly for supporting said connection.

19. An adjustable height target assembly according to claim 1, wherein ends of said counterweight are coated with a material to reduce noise and vibration as said counterweight slides through said tube.

* * * * *